United States Patent [19]

Imperial et al.

[11] 4,029,827

[45] June 14, 1977

[54] MERCAPTO FUNCTIONAL POLYORGANOSILOXANE RELEASE AGENTS FOR FUSERS IN ELECTROSTATIC COPIERS

[75] Inventors: George R. Imperial, Webster; Donald A. Seanor, Pittsford, both of N.Y.

[73] Assignee: Xerox Corporation, Stamford, Conn.

[22] Filed: July 24, 1974

[21] Appl. No.: 491,412

[52] U.S. Cl. ..... 427/22; 148/6.24; 427/194; 427/374 R

[51] Int. Cl.[2] ..... B05D 3/12; C23F 7/00; G03G 13/20

[58] Field of Search ..... 117/17.5, 21, 161 Z, 117/161 A; 118/637, 641, 60, 101; 29/132; 219/216, 388, 469; 260/46.5 R, 46.5 E, 46.5 Y; 427/22, 194, 374; 432/60; 148/6.24; 425/450

[56] References Cited

UNITED STATES PATENTS

| | | | |
|---|---|---|---|
| 2,719,165 | 9/1955 | Cooper | 260/46.5 E X |
| 3,170,940 | 2/1965 | Johnston | 260/46.5 E X |
| 3,346,405 | 10/1967 | Viventi | 260/46.5 E |
| 3,669,707 | 6/1972 | Donnelly et al. | 117/21 |
| 3,810,776 | 5/1974 | Banks et al. | 219/216 |
| 3,848,305 | 11/1974 | Jachimiak | 29/132 |

FOREIGN PATENTS OR APPLICATIONS 1,102,251 2/1968 United Kingdom

*Primary Examiner*—Ronald H. Smith
*Assistant Examiner*—Stuart D. Frenkel
*Attorney, Agent, or Firm*—James J. Ralabate; Ernest F. Chapman

[57] ABSTRACT

Polyorgano siloxanes having functional mercapto groups are applied to a heated fuser member in an electrostatic reproducing apparatus to form thereon a thermally stable, renewable, self-cleaning layer having superior toner release properties for electroscopic thermoplastic resin toners. The polyorgano siloxane fluids having functional mercapto groups interact with the fuser member in such a manner as to form an interfacial barrier at the surface of the fuser member while leaving an unreacted, low surface energy release fluid as an outer layer or film. The interfacial barrier is strongly attached to the fuser member surface and prevents toner material from contacting the outer surface of the fuser member. The material on the surface of the fuser member is of minimal thickness and thereby represents a minimal thermal barrier. The polyorgano siloxanes having mercapto functionality have also been effectively demonstrated as excellent release agents for the reactive types of toners having functional groups thereon.

14 Claims, 2 Drawing Figures

MERCAPTO FUNCTIONAL POLYORGANOSILOXANE RELEASE AGENTS FOR FUSERS IN ELECTROSTATIC COPIERS

BACKGROUND OF THE INVENTION

This invention relates generally to xerographic copying methods and apparatus, and, more particularly, it relates to the fixing of both non-reactive particulate thermoplastic toner and reactive particulate thermoplastic toner having functional groups thereon by direct contact with the surface of a fusing member having a novel polyorganosiloxane fluid release surface.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto.

In order to affix or fuse electroscopic toner material onto a support member permanently by heat, it is necessary to elevate the temperature of the toner material to a point at which the constituents of the toner material coalesce and become tacky. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy for fixing toner images onto a support member is old and well known.

One approach to thermal fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll thereby to affect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner at which temperature the toner particles in the image areas of the toner liquify and cause a splitting action in the molten toner resulting in "hot offset." Splitting occurs when the cohesive forces holding the viscous toner mass together is less than the adhesive forces tending to offset it to a contacting surface such as a fuser roll.

Occasionally, however, toner particles will be offset to the fuser roll by an insufficient application of heat to the surface thereof (i.e., "cold" offsetting); by imperfection in the properties of the surface of the roll; by the toner particles insufficiently adhering to the copy sheet by the electrostatic forces which normally hold them there; or by the reactivity of the toner material itself in those cases where the toner is the type having reactive functional groups. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the foregoing problems, particularly that which is commonly referred to as "offsetting", has been to provide a fuser roll with an outer surface or covering of polytetrafluoroethylene, known by the trade name, Teflon, to which a release agent such as silicone oil is applied, the thickness of the Teflon being on the order of several mils and the thickness of the oil being less than 1 micron. Silicone based oils, (polydimethylsiloxane), which possess a relatively low surface energy, have been found to be materials that are suitable for use in the heated fuser roll environment where Teflon constitutes the outer surface of the fuser roll. In practice, a thin layer of silicone oil is applied to the surface of the heated roll to form an interface between the roll surface and the toner images carried on the support material. Thus, a low surface energy layer is presented to the toner as it passes through the fuser nip and thereby prevents toner from offsetting to the fuser roll surface. This mode, even under optimum conditions, provides only minimal release and is ineffective when the toners are the reactive type having functional groups thereon.

A fuser roll construction of the type described above is fabricated by applying in any suitable manner a solid layer of abhesive material to a rigid core or substrate, such as the solid Teflon outer surface or covering of the aforementioned arrangement. The resulting roll structure is subject to wear and degradation due to continued operation at elevated temperatures and also to damage from accidental gouging by stripper fingers conventionally employed in such systems. The foregoing in many instances necessitates replacement of the fuser roll which is quite costly when a large number of machines are involved.

Moreover, the polytetrafluoroethylene along with the coating of silicone oil is of sufficient thickness to constitute a poor thermal conductor, and longer nip dwell and higher fuser roll temperatures are required to deliver the fusing energy required to fix toner. Also, control of the surface temperature of the roll presents a problem due to large temperature variations occurring before and after contacting of the substrate carrying the images.

In view of the foregoing it would appear that the high thermal conductivity and wear resistance of bare metals or similar materials would be desirable for utilization in fuser roll structures, however, such materials have, heretofore, not been found satisfactory for such application. The latter is attributed to the very high surface energy of metals and similar materials which renders them readily wettable by hot toner materials. Once wetted by hot toner, it has been very difficult if not impossible to remove the toner completely from such materials while they remain hot. Commonly used release agents such as pure silicone oils and mineral oils have been tried in combination with various metals and other high surface energy materials but with relatively little or no success.

It is also reported in U.S. Pat. No. 3,810,776 that offset of toner to a heated fusing roll is prevented by coating the fusing roll with an adhesion preventing layer of an immiscible dispersion of a high viscosity, low surface tension component such as zinc or aluminum stearate or behenate and low viscosity, low surface tension component such as silicone oil. However, at least dual component systems having immiscible ingredients must be applied and/or mixed in order to prevent hot offset. This in turn leads to additional preparation, handling and application problems. Furthermore, these systems are ineffective in preventing hot offset of the toners having reactive functional groups thereon.

OBJECTS OF THE INVENTION

Accordingly, it is the principal object of this invention to provide a new and improved release agent, fusing process and device for use in fixing toner images.

Another object of this invention is to provide, for use in a photocopying apparatus and process, a fusing process, device and release agent wherein the fuser member is self-repairing and therefore has a continuously renewable surface.

Another object of this invention is to provide a fusing process and device wherein toner is displaced from the exposed surface of the fuser member by the action of a single component or multiple miscible component release agent on the surface of the fuser member.

Yet another object of the invention is to provide a fusing process and device employing a release agent wherein the release agent is a solid or liquid at room temperature and a liquid during fusing of the toner images to a substrate.

Another object of this invention is to provide, in fusing device and process for toner images wherein a barrier is formed during operation of the fuser at the interface of the fuser roll surface and a release agent through interaction between the release agent and the fuser roll material.

Still another object of this invention is to provide a new and improved release agent, device and method for fusing toner images to a substrate wherein toner barrier and toner release coatings are formed on a thermally conductive core and wherein the combined thickness of the coatings is insufficient to establish an appreciable thermal barrier to the energy being conducted through the core, thereby lowering the power requirements for maintaining a heated core and for the overall fusing operation.

Another object of this invention is to provide an improved release agent for the fusing of reactive thermoplastic resin toners of the type having functional groups.

Other objects and advantages of the present invention will become apparent when read in conjunction with the accompanying drawings and specification.

SUMMARY OF THE INVENTION

The above-cited objects of the present invention are accomplished by applying a polyorganosiloxane having mercapto functional groups to a heated fuser member in an electrostatic reproducing apparatus. The mercapto functional groups of the polymeric organosiloxane fluid must be capable of interacting with the fuser member surface to form a thermally-stable barrier to toner, said barrier designated herein as an interfacial layer, which strongly adheres to the metal, glass or other surface material of the fuser member and provides a thin coating which has substantially superior release properties for the toners used in electrostatic printing as well as superior stability when compared with other polymeric fluids having functional groups as set forth in a copending application filed herewith and assigned to the same assignee. The functional mercapto groups are generally known as chemically reactive groups. The mercapto functional polyorganosiloxane fluid may be applied to the surface of the fuser member in thicknesses ranging from submicron to several microns to constitute a minimal barrier to heat transfer. By employing the release agent and process of this invention there is provided a fuser member having in essence a bare surface surrounded only by a minute layer of material which prevents toner from contacting the surface.

While the mechanism is not completely understood, it has been observed that when the polyorganosiloxanes having functional groups are applied to the surface of a fuser device, there is an inter-action (a chemical reaction, coordination complex, hydrogen bonding or other mechanism) between the metal or glass surface of the fuser and the polyorganosiloxanes having functional groups, so that an interfacial barrier layer comprising the reaction product between the metal, glass or other material of the fuser member and the functional polyorganosiloxane forms a barrier layer intermediate the metal or glass or other substrate of the fuser member and the outer layer of polyorganosiloxane fluid coating the fuser member. This outer layer may be referred to as the non-reacted release layer, or generally, the release layer. The films, however formed, has been observed to have a greater affinity for the fuser substrate material than the toner and thereby prevents electroscopic thermoplastic resin toners and modified toners having functional groups from contacting the core, while the release coating provides a material the cohesive force of which is less than the adhesive forces between the heated toner and the substrate to which it is applied, and the cohesive forces of the toner. Not only do these coatings have substantially superior release properties, but it has also been observed that the thermally-stable layer is continuously renewable and self-repairing. That is to say, if this coating is damaged, for example, by uneven pressures exerted by the blade utilized for metering the release material to the core, or by undue forces exerted by the finger employed for stripping the substrate from the fuser roll structure, the thermally-stable coating will repair itself.

It was unexpectedly found that the polyorganosiloxanes having mercapto functional groups were useful as release agents for not only the conventional, non-functional thermoplastic resin toners but also the modified toners having functional groups or reactive groups as hereinafter described. Thus, the mercapto functional polyorganosiloxanes are not only substantially superior release agents, but they are also useful for functionally modified toners.

It was also observed unexpectedly that not only the non-functional thermoplastic resin toners but also the modified toners having functional groups used in electrostatic printing are displaced from damaged or worn areas which interrupt the coating on the heated fuser member when the mercapto functional polyorganosiloxanes are used in accordance with the present invention. The softened or tacky toner is substantially removed by the functional polyorganosiloxane fluids having the chemically reactive functional mercapto groups, and the fluids repair the interrupted, damaged or worn area. This mechanism has substantially reduced offset problems common to the devices and processes of the prior art.

By using the term mercapto functional polyorganosiloxane fluid in describing the coating materials or release fluids of this invention is meant the state which the polymeric material assumes at operating temperatures. Thus, the polyorganosiloxane material having the chemically reactive functional mercapto groups may be a solid or a liquid at ambient temperature and a fluid at operating temperatures. By using the term "polymeric" is meant two or more monomer units as a backbone having chemically reactive functional groups attached thereto capable of interacting with the fuser member to form a barrier to toner and having a surface energy less than the surface energy of the toner at operating temperatures.

In the process of the present invention it is critical that the polyorganosiloxane fluid contain chemically reactive functional mercapto groups which interact with the fuser member surface to form a thermally stable interfacial barrier to toner. It is also critical that the mercapto functional polyorganosiloxane fluid displace electroscopic resin toner when it is coated upon the fuser member or to the fluid layer itself. By use of the phrase "capable of displacing toner" as used herein, is meant that the mercapto functional polyorganosiloxane is operable in preventing the toner from contacting the surface of the fuser member and is more reactive than the toner with the material of the fuser member surface to the extent that it repels or displaces the toner from the surface of the fuser member even when the surface thereof is exposed to or contacts the toner.

DESCRIPTION OF THE PREFERRED EMBODIMENTS

Figure 1:
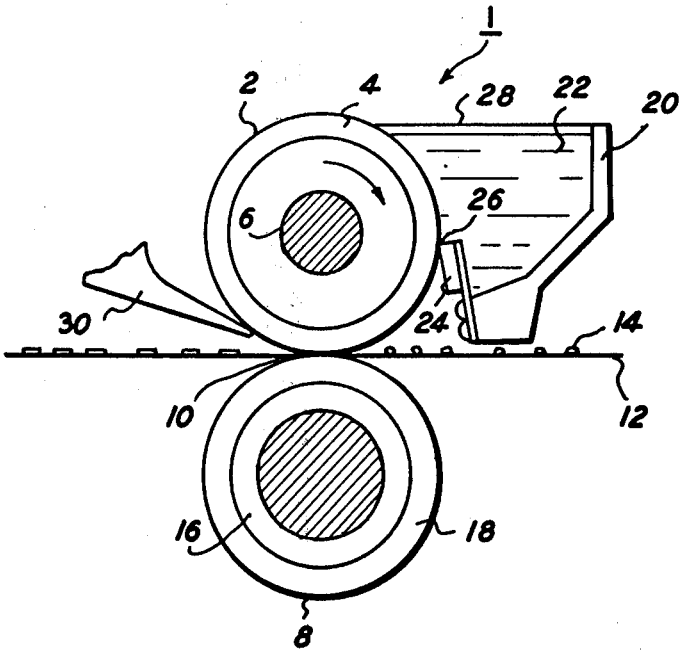
FIG. 1 is a typical side elevational view of a fuser system for a xerographic reproducing apparatus.

The mercapto functional polyorganosiloxane capable of displacing conventional non-functional electroscopic thermoplastic resin toner and modified toners having functional groups are operable in accordance with the present invention only when the appropriate mercapto functionality is present in the fluid. This polymeric fluid, which also must have a suitable release function for the toners, must also be capable of forming an interfacial barrier between the metal, glass or other material of the fuser member and the outer layer of the same fluid release material.

The present invention encompasses polyorganosiloxanes which are characterized by the above-described properties and which have built-in mercapto functionality. By the use of the term "built-in" mercapto functionality, is meant any polyorganosiloxane material which is characterized by mercapto functional groups (-SH). The organosiloxane polymers are generally designated as inorganic polymers because of the siloxane backbone structure comprising alternate silicon and oxygen atoms in the backbone. The polysiloxane chain itself $(—Si—O—Si—O—)_n$ is typically inorganic in nature, and because of this polysiloxane chain it is characteristically thermally and chemically stable. However, it may also be considered organic in nature because of the hydrocarbon spacer groups and side chains which are a part of the molecule and attached to the siloxane backbone.

A typical mercapto functional polysiloxane backbone is of the dialkyl type having the general formula:

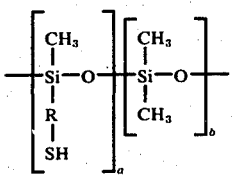

wherein R represents a "spacer" group pendant from the polymer backbone and SH is the mercapto functional group. In preferred embodiments R is an alkyl moiety having about 1–8 carbon atoms typicaly a propyl group $(—CH_2—CH_2—CH_2—)$. For a typical polymer having a 1 mole percent functional content, there is 1 a moiety for every 99 *b*'s. If the mercapto functional group content is 2 mole percent, there is an average of 2 a moieties for every 98 *b* moieties. The R spacer groups may all be similar for example, methyl, ethyl or propyl, or they may be mixtures or alkyl groups, for example, mixtures of propyl and butyl or ethyl and propyl, and the like. Furthermore, the R spacer group may be straight chain or branched. The typical molecule shown in the general formula above comprises methyl groups substituted on the Si atoms in non-spacer group sites. However, these non-spacer group sites may typically comprise general alkyl groups from about 1 to 6 carbons and mixtures thereof. Other groups may be subsituted at these sites by one skilled in the art as long as the substituted groups do not interfere with the mercapto functional groups designated in the general formula by —SH. The R-SH groups may be randomly positioned in the molecule to provide the functional groups critical in the release agents, processes and devices of the present invention. Alternatively, or in addition, the mercapto functional groups (—SH) may be located on spacer groups (R) at terminal sites on the molecule, i.e., the molecule may be "end-capped" by the mercapto functional groups. As used herein, release agent, mercapto functional release agent, polymeric fluid, mercapto functional polyalkyl siloxane and mercapto functional polydialkyl siloxane may be used interchangeably and refer to the modes set forth above.

In order to provide suitable release of thermoplastic toner with improved offset when bare fuser rolls are used in the process and device of the present invention, the polyorganosiloxane release agents having chemically reactive mercapto functional groups must have the following properties either before, during, or after application to the fuser member surface. The mercapto functional polydialkyl siloxane are release agents preferably non-volatile, that is, they must not produce excessive levels of volatile fumes and vapors which penetrate the surrounding atmosphere and thereby cause deposits upon surrounding parts in the copying apparatus or fumes which are toxic, in the environment. The mercapto functional polyalkylsiloxane release material upon the fuser member must be thermally stable, that is, the fluid must not form a gel or decompose at operating temperatures over reasonable periods of time, for example, at least about 200 hours at operating temperature. This is dependent upon the particular requirements of the machine and machine use. The mercapto-functional polyalkyl siloxane fluid is preferably noncorrosive to the machine parts and to the paper, and it must be non-reactive, that is, inert, to the toner used in the development of the electrostatic latent image. The mrcapto-functional polydialkyl siloxane fluids must produce a low energy surface to the toner which is undergoing fusing by heat, that is, it must be abhesive and the surface energy must be less than the surface energy of the molten or heated toner. For example, when toners generally having a room temperature surface energy of about 28–36 dynes/cm. are used, the fluid must have a surface energy less than that of the toner. The interfacial layer is preferably impenetrable to the toner, that is, the electroscopic thermoplastic resin toner whether of the reactive or non-reactive type toner, applied to the fuser member and softened must not be able to penetrate the intact interfacial barrier layer so that the fuser member surface will be exposed to toner particles which may become entrapped within the layers upon the member. The fluids must be capable of application to the fuser member in minute thicknesses preferably of the order of magnitude of 10 microns or less so that only a minimum thermal barrier will be coated upon the bare fuser member. It is also preferred that any interfacial layer which forms a barrier between the fuser member surface and the outer release layer remain insoluble in the nonvolatile fluid release layer even at the operating temperatures of the device. The viscosity of the mercapto functional polyorganosiloxane is preferably higher than about 20 centipoise at 320° F.

Generally, the modes in which the mercapto functional polyalkyl siloxane release agents of the present invention are utilized are those wherein the coating can be continuously applied to the surface of the fuser member, and accordingly, the coating is deemed self-renewing in these cases. The polymeric fluid having functional groups therein may be applied to the fuser member by any of the standard or conventional methods or devices known to those skilled in the art, and include application by brushes, by spraying, by metering from a sump, by application from a wiper blade or wiper comprising the polyalkylsiloxane fluid having the mercapto functional groups therein, by applying from a suitable sump, by applying from another roll or a wick, by padding, and the like. In general, one skilled in the art will be able to use this invention in the fuser assembly of a copying device wherein thermoplastic resin toner, whether of the reactive (having functional groups) or non-reactive, applied to a substrate in image configuration must be heated or fused in order to fix permanently the colored substance in image configuration upon the substrate. The mercapto functional polydialkylsiloxane release material may also be applied in the form of a solid which becomes fluid at operating temperatures, for example, a block of the polymer having suitable mercapto functional groups may rub against the heated fuser member to apply a film of the polymer on the fuser member. The polymeric release agent may also be applied in conjunction with a cutting or dilution agent with which it is miscible, that is, as two or more miscible components. An example of this embodiment is a mixture of the polydimethylsiloxane having functional mercapto groups attached to a propyl spacer group mixed with the polydimethylsiloxane (silicone oil) with which it is miscible and which acts as a dilution agent. Typical blends include 50/50 and 25/75 mercapto functional release material to silicone oil. The mercapto functional release agents of the present invention may also be applied as a single component to provide both the interfacial barrier and the release surface.

In applying the mercapto functional release fluid capable of displacing electroscopic thermoplastic resin toner, to the surface of the fuser member, the polymer fluid containing chemically reactive mercapto functional groups capable of interacting with the fuser member surface to form a thermally stable interfacial barrier to the toner, the fluid must be applied in an amount sufficient to cover the surface with at least a continuous low surface energy in order to provide the fuser member with a surface which not only release a thermoplastic resin toner heated by the fuser member but also with an amount which will prevent the thermoplastic resin toner, whether functional or non-functional toner, from contacting the surface of the fuser member. Generally, in accordance with the objects of the present invention, the amount sufficient to cover the surface must be that amount which will maintain a thickness of the fluid in a range of submicron to microns and is preferably from about 0.5 micron to about 10 microns in thickness. Thus, in essence, the layer of the polymeric fluid on the surface of the fuser member is so slight that there is essentially a bare fuser member. Although this layer or coating of the polymeric fluid having chemically reactive mercapto functional groups, may be applied to the fuser member surface intermittently, it is generally preferred to apply the fluid dentinuously on the heated fuser member to maintain thereon a coating of the polymeric fluid and the produce or products formed by interaction with the material of the fuser member. During operating of any automatic electrostatic reproducing apparatus, it is generally preferred to continuously apply the fluid on the heated fuser member in order to replace that fluid which is retained by the substrate when the substrate is the type which absorbs the fluid or to which the fluid may adhere, generally in an amount which is measured in fractions of a microliter for each copy. However, in embodiments where there is little or no loss of the polymeric fluid having chemically reactive functional groups, from the surface of the fuser member, continuous application of the fluid may not be necessary, and it may be preferred to utilize application techniques which only apply fluid intermittently to the surface.

In order to be operable in accordance with the present invention, the polymeric fluids having chemically reactive mercapto functional groups which are applied to the fuser member and capable of displacing electroscopic thermoplastic resin toner, must not be curable to the extent that they form a solid or gel at operating temperatures at reasonable periods of time as discussed supra. The reasonable time is dependent upon the copier volume, and a reasonable period of time for a high volume copier is at least about 200 hours whereas a reasonable time for a low volume copier is preferably longer than 200 hours and may be 1,000 to 2,000 hours or longer. Thus, if the polymeric fluids applied to the fuser member are of the type which form solids or gels at the temperatures at which the apparatus operates generally from about 250°–400°F, they are not suitable for use in accordance with the present invention. Furthermore, the polymeric fluids having chemically reactive mercapto functional groups must provide a fluid layer at operating temperatures upon the surface of the fuser assembly, and those species which rapidly form a solid or gel at layer 64 in FIG. 2, as by crosslinking and the like, cannot be used in accordance with the present invention.

In general, the method of the present invention applies to fusing electroscopic thermoplastic resin toner images to a substrate and includes the steps of forming a coating or layer on a heated fuser member of an electrostatic reproducing apparatus, said coating being a barrier to reactive and non-reactive electroscopic thermoplastic resin toner and comprising the product resulting from the interaction of the fuser member and a polymeric fluid having chemically reactive mercapto functional groups thereon, said polymer being fluid at the temperatures of the fuser member and acting as a release coating for the electroscopic thermoplastic resin toner. The toner image on the substrate is contacted with the heated fuser member for a period of time sufficient to soften the electroscopic thermoplastic resin toner, and the softened toner is allowed to cool. The toner barrier coating and the fluid toner release coating are preferably on the order of about 0.5 micron in thickness. The thickness of the barrier coating and release layer are limited only to the extent that such barrier coating and release layer do not prevent heat transfer from the inner core of the fuser member to the thermoplastic resin toner undergoing fusing upon a substrate, and to the extent that there is a sufficient film of the release material on the surface of the fuser member to prevent hot offsetting on the heated fuser member, that is, to prevent the retention of the tackified or molten thermoplastic resin toner by the surface of the heated fuser member so that the retained toner will not transfer to the next substrate contacting the heated fuser member.

The electroscopic thermoplastic resin toner that forms the toner images, for example, numeral 14 in FIG. 1, is comprised of a thermoplastic resin in addition to colorant such as dyes and/or pigments. Examples of conventional pigments are carbon black and furnace black. Tje developer material may also contain cleaning materials and plasticizers in accordance with the desired formulation.

In accordance with the present invention, these toners are of two types, the non-reactive toners and the reactive toners. The non-reactive toners do not have functional groups thereon which are capable of interacting with the fuser member material. The reactive toners have functional groups thereon which are chemically reactive and which are generally capable of interacting with the fuser member material. These reactive toner materials are not released by the conventional electroscopic resin toner release agents now known in the art. However, in accordance with the present invention, it has been found that the mercapto functional polyalkyl siloxanes are excellent release agents for these toners in a tackified state and are even operable in excluding and displacing such reactive toners from the surface of the fuser member. In addition, the release properties of the mercapto functional polyalkyl siloxanes is surprisingly substantially superior to the other know release agents having functional groups as set forth in copending patent applications assigned to the same assignee and filed herewith. Typical toners may be chosen by one skilled in the art.

An example of a non-reactive or non-functional toner is a copolymerized mixture of styrene or a blend of sytrene monologs with 10–40 percent (by weight) of one or more methacrylate esters selected from group consisting of ethyl, propyl and butyl methacrylates as described in U.S. Pat. No. 3,079,342 may be used, said reference being incorporated herein by reference. Typical toner materials include gum copal, gum sandarac, rosin, asphaltum, pilsonite, phenol formaldehyde resins, rosin-modified phenol formaldehyde resins, methacrylic resins, polystyrene resins, polypropylene resins, epoxy resins, polyethylene resins and mixtures thereof. Among other patents describing non-reactive thermoplastic electroscopic toner compositioare U.S. Pat. Nos. 2,659,670 to Copley; 2,754,408 to Landrigan; 3,079,342 to Insalaco; Reissue No. 25,136 to Carlson and U.S. Pat. No. 2,788,288 to Rheinfrank et al.

An example of a reactive or functional toner which is unexpectedly released from heated fuser members having a film of mercapto functional polyalkyl siloxane thereon in accordance with the present invention, is a polymeric esterification product of a dicarboxylic acid and a diol comprising a diphenol. Typical reactive or functional toners are described in U.S. Pat. No. 3,590,000 to Palermiti and Chatterji, which is incorporated herein by reference. What is claimed therein is a solid xerographic developer material comprising particles, said particles including finely divided toner material having a particle size range of up to about 30 microns and a melting point of at least about 110°F, said toner material comprising a colorant selected from the group consisting of pigments, dyes and mixtures thereof and a resin consisting essentially of a polymeric esterification product of a dicarboxylic acid and a diol comprising a diphenol; and from about 0.02 percent to about 20 percent, by weight, based on the weight of said toner material, of at least any solid, stable hydrophobic metal salt of a fatty acid available at external surfaces of said particles. This class of reactive toners is described herein as modified thermoplastic resin toners having functional groups. These functional groups are of the type which react with the surface of the fuser member.

For mercapto-functional polyalkyl siloxanes, the concentration or amount of functional groups present in the polymeric release fluid containing chemically reactive mercapto functional groups (-SH) to displace electroscopic thermoplastic resin toner is generally preferred in a concentration of 2.0 or less mercapto groups per molecule. Higher mercapto functionality may be present in the polymeric fluids containing chemically reactive mercapto groups, depending upon the mode of application of the fluid, for example, polymeric fluid containing up to 10 mercapto groups or higher per molecule may be operable. As explained supra, the polymers may be diluted or cut by the addition of miscible, non-functional materials before or during application to the fuser member. Although concentrations of functional groups in the polymeric fluids greater than 10 mole percent may be utilized in accordance with the present invention, there generally is no advantage in utilizing concentrations higher than 10 mole percent. Mercapto groups in concentrations as low as even about 0.2 functional groups per molecule have produced satisfactory results. To treat the surface of a heated fuser member in an electrostatic reproducing apparatus by applying at least one polymeric fluid containing chemically reactive mercapto functional groups, one skilled in the art can adjust the concentration of the functionality of the polymeric fluids to provide optimum release and fusing latitude. A suitable or optimum concentration of mercapto functional groups of the polymeric fluid can be determined by carrying out a simple test. The test must be conducted upon the same base metal which will be utilized in the fuser member surface since the fusing latitude and release properties of the polymeric fluid vary with the composition of the fuser member. Concentrations of the mercapto groups on the polymeric fluids may be adjusted to provide optimum fusing latitude and release in accordance with the speed at which the thermoplastic resin toner is to be fused. The test may be carried out on a small heated roll fixture having the desired metal, glass or other suitable surface with a suitable backup or pressure roll. Speed and nip pressure may be adjusted as desired, and the test material may be metered onto the fuser roll member by a suitable device, for example, a metering device such as a blade from a sump system. Temperature can be controlled and the surface temperature on the fuser roll can be determined by a suitable thermocouple. The minimum fuser temperature and the hot offset temperature can be observed for the particular polymeric fluid containing a measured quantity or concentration of chemically reactive mercapto functional groups. Unfused thermoplastic resin toner on a substrate can then be fed into the fuser member nip and the latitude test and release characteristics including thermal stability of the material can be determined. Various metals can be tested merely by changing the fuser roll member in the test device, and various polymeric release agents (the concentration, amount or location of chemically reactive mercapto functional groups) can be determined by changing the solid or fluid material in the sump or by changing the solid or fluid material having chemically reactive mercapto functional groups in any other type of applicator device.

The surface to which the polymeric material (which may be a solid but which must be fluid at operating temperatures) is applied, must be heated to insure proper formation of the interfacial layer which is the result of interaction between the polymeric fluid containing chemically reactive mercapto functional groups and the surface of the fuser member. Thus, the interfacial layer becomes heated and remains as a barrier layer upon the surface of the fuser member. Generally, the unreacted or virgin release fluid as it is applied to the fuser member, is heated to the temperature of the fuser roll, however, the release fluid may be somewhat cooler than the roll during operation of the device when heat transfer takes place, that is, when heat is transferred from the fuser member to the substrate containing thermoplastic resin toner undergoing the fuser process. The temperature may be adjusted by one skilled in the art in accordance with the particular type of thermoplastic resin toner, in accordance with the speed of the apparatus, and in accordance with any other parameters which are known to one skilled in the art.

The molecular weight of the polyalkyl siloxane fluids containing chemically reactive mercapto functional groups must be sufficiently high so that the fluid is not too volatile. Molecular weights on the order of 5,000 have been found satisfactory with preferred molcular weights being about 10,000 to 15,000 and higher. If the molecular weight of the polymer fluid is too low, volatile materials which may be corrosive or which may be irritating, hazardous, or offensive may evolve. If the molecular weight of the polymeric material is too high, metering is difficult and coating thickness is difficult to control, and the fluid may become tacky to the resinous toners. Thus, when mercapto functional polyalkyl siloxanes are utilized to treat the surface of a fuser member in an electrostatic reproducing apparatus, the molecular weight of the release material should be chosen so that volatile materials are not evolved; so that there is no low adhesive force between the fluid and the toner. A suitable or optimum molecular weight can be selected without the necessity of undue experimentation by observing the behavior of the particular fluid during the test outlined above for determining the concentration of the mercapto functional groups needed in the fluid. Low molecular weight fractions can be removed from an otherwise suitable fluid to produce a suitable polymeric fluid containing chemically reactive mercapto functional groups and having a molecular weight within the optimal range.

The release failure of the polymeric fluid having chemically reactive mercapto functional groups is related to the splitting of the image when the toner is softened and becomes sufficiently sticky to adhere to the surface of the fuser roll which results in a partial or ghost image on the next sheet, producing what is referred to as an offset image. Therefore, the release property of the particular polymeric fluid applied to the fuser member surface is a function of the offset image, and the higher the temperature of the fuser member before hot offsetting occurs, the better the release properties of the particular fluid. Furthermore, the greater the fusing latitude, that is the temperature at which the thermoplastic resin toner begins to fuse up to the temperature at which hot offset occurs, is also a function of the release properties of the polyalkyl siloxane fluid containing chemically reactive mercapto functional groups. This fusing latitude, that is, the temperature range at which the fusing member can operate and including the temperature from which the thermoplastic resin toner begins to fuse up to the temperature where hot offset begins to occur, is also known as the fusing window of the fuser member. The fusing latitude is substantially and unexpectedly improved with the polyalkyl siloxane fluids having chemically reactive mercapto functional groups.

One method of fusing the toner material to the substrate is a fuser assembly which comprises a heated roll structure including a hollow cylinder or core having a suitable heating element disposed in the hollow portion thereof which is coextensive with the cylinder. The heating element may comprise any suitable type of heater for elevating the surface temperature of the cylinder to operational temperatures which are generally from 250°–400° F, and for example, may be a quartz lamp. The cylinder must be fabricated from any suitable material capable of accomplishing the objects of the invention, that is, a material which not only will transfer to the surface to provide the temperature required for fusing the toner particles, but also a material having a surface which is capable of interacting with the polyalkyl siloxane release agent having mercapto functional groups to form a product which becomes an interfacial layer or barrier layer to toner intermediate the release layer and the surface of the bare fuser member to prevent toner particles from contacting the fuser surface.

Typical fuser member materials are anodized aluminum and aluminum, steel, stainless steel, nickel, and alloys thereof, nickel plated copper, copper, glass, zinc, cadmium, and the like and various combinations of the above. The cylinder may also be fabricated from any suitable material which is non-reactive with the release agents as long as the surface of the cylinder is coated with a material capable of accomplishing the objects of the present invention, especially one which is capable of interacting with the polymeric release fluid having mercapto functional groups. Surface temperature of the fuser member may be controlled by means known to those skilled in the art, for example, by means described in U.S. Pat. No. 3,327,096.

In general, the fuser assembly further comprises a backup member, such as a roll or belt structure which cooperates with the fuser roll structure to form a nip through which a copy paper or substrate passes such that toner images thereon contact the fuser roll structure. The backup member may comprise any suitable construction, for example, a steel cylinder on a rigid steel core having an elastomeric layer thereon, or it may be a suitable belt material which provides the necessary contact between the fuser member and the substrate carrying the developed latent image. The dimensions of the fuser member and backup member may be determined by one skilled in the art and generally are dictated by the requirements of the particular copying apparatus wherein the fuser assembly is employed, the dimensions being dependent upon the process speed and other parameters of the machine. Means may also be provided for applying a loading force in a conventional manner to the fuser assembly to create nip pressures on the order of about 15 to about 150 psi average.

The fuser member treated by the method of the present invention wherein at least one polyorgano siloxane fluid capable of displacing electroscopic thermoplastic resin toner is applied to a fuser member surface, said siloxane fluid containing chemically reactive functional mercapto groups capable of interacting with the fuser member surface to form a thermally stable interfacial layer and being applied in an amount sufficient to cover the surface with at least a continuous, low surface energy film of the fluid to prevent either reactive or non-reactive thermoplastic resin toner from contacting the surface of the fuser member and to provide a surface which releases the thermoplastic resin toner heated by the fuser member, is illustrated in the fuser assembly shown in FIG. 1. In FIG. 1, the numeral 1 designates a fuser assembly comprising heated roll structure or solid substrate 2, backup roll 8 and sump 20. Heated roll structure or solid substrate 2 includes a hollow cylinder or core 4 having a suitable heating element 6 disposed in the hollow portion thereof which is coextensive with the cylinder.

Backup roll 8 cooperates with roll structure or solid substrate 2 to form a nip 10 through which a copy paper or substrate 12 passes such that toner images 14 thereon contact fuser roll or solid substrate 2. As shown in FIG. 1, the backup roll 8 has a rigid steel core 16 with an elastomer surface or layer 18 thereon.

Hollow cylinder or core 4 being fabricated of metal such as anodized aluminum, aluminum and alloys thereof, steel, nickel and alloys thereof, copper, and the like as described above or glass, has a surface made of relatively high surface energy materials, and consequently toner material 14 contacting such surfaces when they are heated, would readily wet the surface. Accordingly, there is provided in accordance with the embodiment of FIG. 1, sump 20 for contacting a polymeric release agent 22 capable of displacing reactive (having functional groups) or non-reactive electroscopic thermoplastic resin toner when said material is in a fluid state, said polymeric release material containing chemically reactive mercapto functional groups which are capable of interacting with the fuser member surface to form a thermally stable interfacial layer thereon when in the fluid state. The polymeric release material 22 may be a solid or liquid at room temperature, but it must be a fluid at operating temperatures having a relatively low viscosity at the operating temperatures of the fuser roll structure or solid substrate 2. Release material 22 in sump 20 must have built-in chemically reactive mercapto functional groups capable of interacting with the surface material 2 found on hollow cylinder or core 4. In the embodiments of this invention, the chemically reactive groups of the polyorgano siloxane release material 22 in sump 20 are mercapto.

In the embodiment shown in FIG. 1 for applying the polymeric release material 22 solid substrate 2, a metering blade 24 preferably of conventional non-swelling rubber is mounted to sump 20 by conventional means such that an edge 26 thereof contacts the solid substrate 2 of the fuser roll structure to serve as a metering means for applying the release material having chemically reactive groups 22 to the fuser roll in its liquid or fluid state. By using such a metering blade, a layer of polymeric release fluid 22 can be applied to surface or substrate 2 in controlled thicknesses ranging from submicron thicknesses to thicknesses of several microns of the release fluid. Thus, by metering device 24, 0.1 – 0.5 micron or greater thicknesses of release fluid can be applied to substrate 2. In the embodiment shown, a pair of end seals 28, for example, of sponge rubber, are provided to contain the release material 22 in sump 20. One or more stripper fingers 30 may be provided for insuring removal of the substrate 12 from substrate 2. In one of the preferred embodiments, the thermoplastic resin toner is fused to paper, however, thermoplastic resin toner (both reactive and non-reactive) may be fused to other substrates such as polymeric films by the fuser members and process of the present invention, the only limitation being that the polymeric fluids having chemically reactive mercapto functional groups must not adversely react with the substrate upon which the toner is used and must not destroy or alter the coloring properties of the thermoplastic resin toner.

The embodiment described above in FIG. 1 is merely one of the preferred means for applying a layer of polymeric release material containing chemically reactive mercapto functional groups capable of interacting with the fuser member surface to form a thermally stable interfacial barrier layer in an amount sufficient to cover the surface with at least a continuous, low surface energy film of the fluid to provide the fuser member with a surface which releases thermoplastic resin toner heated by the fuser member. Other means for applying the polymeric release fluid which is abhesive to electroscopic thermoplastic resin toner and having mercapto functional groups which interact with the solid substrate of the fuser member, comprise means which spray a layer of the release fluid upon the fuser surface, a pad or sponge-like material which pads a coating of the polymeric release fluid having chemically reactive mercapto functional groups on the surface of the fuser member, a wick which contacts the surface of the fuser member to provide a film or layer of the polymeric release material having chemically reactive mercapto functional groups, extruding means which extrude a minute film of the polymeric release material having chemically reactive mercapto functional groups on the fuser member, a brush having fibers or bristles comprised of the polymeric release material having chemically reactive mercapto functional groups or a brush or bristle having the polymeric release fluid having chemically reactive mercapto functional groups on the surfaces of the bristles or brush materials, a fluid soaked roll or wick and the like.

Figure 2:
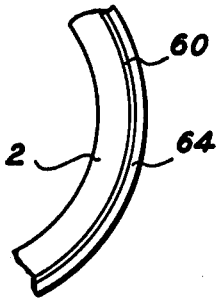
FIG. 2 is a fragmentary view of a fuser member of the present invention.

The fuser member for an electrostatic reproducing apparatus resulting from the method of treating the surface of a heated fuser member with at least one polymeric fluid capable of displacing electroscopic thermoplastic resin toner, is shown in FIG. 2. The fuser member shown in FIG. 2 is magnified many times over the member shown in FIG. 1 in order to show the thin layers on the fuser member surface. In FIG. 2, the heated roll structure or solid substrate is designated by numeral 2. A release layer of fluid is designated by numeral 64 and an interfacial layer is designated by numeral 60. Thus, there is described a fuser member having a solid substrate 2, a release layer of polyorganofunctional siloxane fluid 64 which is abhesive to reactive and non-reactive electroscopic thermoplastic resin toner and having chemically reactive mercapto functional groups which interact with the solid substrate 2, and interfacial layer 60 which prevents the electroscopic thermoplastic resin toner (not shown) from contacting solid substrate 2, said interfacial layer 60 being formed by the interaction of solid substrate 2 and the chemically reactive mercapto functional groups of polyorganofunctional siloxane fluid release layer 64.

In one of the preferred embodiments, solid substrate 2 of FIG. 2, comprises a metal capable of forming oxides, and in more preferred embodiments, the solid substrate 2 may be selected from the group consisting of iron, copper, aluminum, titanium, zinc, silver, nickel and cadmium and oxide-forming alloys thereof. Solid substrate 2 may also be comprised of glass.

In accordance wih the present invention, it has been unexpectedly observed that when solid substrate 2 in FIG. 2 is an oxide-containing or -forming material and the polymeric fluid 64 is the type having mercapto functional groups, and electroscopic thermoplastic resin toner is applied thereto and softened, the electroscopic thermoplastic resin toner (either reactive or non-reactive) is displaced from solid substrate 2 by the action of mercapto-functional polyorganofunctional siloxane polymeric fluid 64 applied thereto when release layer 64 and interfacial layer 60 are interrupted, and the surface of the substrate 2 is exposed to the toner. Interruptions in the release layer 64 and interfacial layer 60 may occur, for example, by scraping of the surface by the stripper finger, by a thermistor device to control the temperature at the surface, by other abrasive forces which scratch or deface the layers coated on solid substrate 2, and the like. Thus, when the reactive or non-reactive electroscopic thermoplastic resin toner is applied to the surface which has been interrupted by such forces, it was unexpectedly found that the electroscopic thermoplastic resin toner is displaced from the solid substrate 2 by the action of the polymeric release layer material as it is applied to the fuser member. Although the details of this mechanism are not completely understood, it is believed that the polyalkyl siloxane release fluids having chemically reactive mercapto functional groups, actually compete with the electroscopic thermoplastic resin toner (even of the reactive type) for the surface of substrate 2, and because the release material having the chemically reactive mercapto groups is more reactive toward the solid substrate surface 2 than is the electroscopic resin toner, the release material actually displaces the electroscopic thermoplastic resin toner from substrate 2 as it reforms interfacial layer 60 in the interrupted zone or portion of the surface by the interaction of the release material 64 and the surface 2. Thus, by using the electroscopic thermoplastic resin toners, even those which have functional groups thereon and are deemed reactive, the release layer fluid having mercapto functional groups thereon, is found to actually displace the electroscopic thermoplastic resin toner applied to and softened upon the surface of the fuser roll from any interruptions occuring therein, thereby preventing offsetting of the material and ghosting of the image.

The following examples further define, describe and compare exemplary materials for treating the surfaces of heated fuser members in an electrostatic reproducing apparatus with polyorganofunctional siloxane fluids capable of displacing electroscopic thermoplastic resin toner, the fluids containing chemically reactive mercapto functional groups capable of interacting with the fuser member surface to form a thermally stable interfacial layer thereon. Parts and percentages are by weight unless otherwise indicated. Molecular weights are number average unless otherwise specified. The examples are also intended to illustrate the various preferred embodiments of the present invention. Unless otherwise specified, the polyalkyl siloxane fluids containing chemically reactive mercapto functional groups, and electrostatic latent image was formed on a conventional recording surface in a conventional electrostatic reproducing apparatus, and the electrostatic latent image was developed with either a heat fusible non-reactive toner comprising carbon black pigmented copolymer, styrene-n-butylmethacrylate, the toner particles being held on the recording surfaces in conformance with the electrostatic latent image or a reactive toner comprising a colorant, a solid, stable hydrophobic metal salt of a fatty acid and a polymeric esterification product of dicarboxylic acid and a diol comprising a diphenol as exemplified and prepared in Example II of U.S. Pat. No. 3,590,000 incorporated herein by reference. The toner image was thereafter transferred to plain paper. The paper having the toner images electrostatically adhered to was then passed at a speed of about 3–5 inches per second between a fuser roll structure and a backup roll, the fuser roll structure being the type wherein temperature can be controlled as well as nip pressure. The toner image is contacted to fuser roll structure which had a 2.0 inch outside diameter and which was 15 inches long. The backup roll had an outside diameter of about 2.0 inches with a 0.1 inch layer of silicone rubber covered with a 0.020 inch coating of fluorinated ethylene-propylene resin on the surface and having a durometer of 65 Shore A. The fuser roll structures were fabricated from metals having the finishes described in the examples set forth below. Release agents consisting of the materials described below were liquified and metered onto the fuser roll prior to contacting thereof by the toner image. Fusing latitude or fusing window was then determined.

In the fuser fixture and apparatus described supra, using a copper fuser roll, polydimethyl siloxanes having mercapto groups attached to alkyl spacer groups were applied to the fuser roll from the sump. A conventional toner comprising a copolymerized mixture of styrene and about 25 percent (by weight) propyl methacrylate ester having carbon black pigment and supplied by Xerox Corporation under the designation of 364 Toner was fused. The results are shown in Table I below. The approximate molecular weight of each sample, the alkyl spacer group, the viscosity at 25° C, the amount of sulfur (S) per molecule, the fusing latitude (release), and the thermal stability are included in Table I. Unless otherwise indicated, the mercapto functionality was located on side chain spacer groups.

TABLE I

| EXAMPLE NO. | MOL. WT. | SPACER GROUP | VISCOSITY (centi-stokes) | S per MOLECULE | *THERMAL STABILITY | **FUSING LATITUDE |
|---|---|---|---|---|---|---|
| I | 14,000 | Propyl | 287 | 0.35 | 49 days | to 420° F. |
| II | 14,000 | Propyl | 247 | 0.35 | 49 days | to 450° F. |
| III | 14,000 | Propyl | 275 | 0.18 | 49 days | to 550° F. |
| IV | 14,000 | Propyl | 290 | 0.44 | 14 days | to >360° F. |
| V | 14,000 | Propyl | 385 | 0.75 | 14 days | to 390° F. |
| VI | 14,000 | Propyl | 280 | 0.44 | 6 days | to 330° F. |
| VII | 15,000 | Propyl | 306 | 0.4 | 17 days | to 420° F. |
| VIII | 5,000 | Propyl | 81 | 0.23 | 14 days | to 370° F. |
| ***VIIIa | 14,000 | Propyl | 160 | 0.04 | 49 days | to >450° F. |

*Thermal Stability shown as greater than a designated number of days at continuous 400° F. A fair thermal stability is 2–6 days and a good thermal stability is greater than 2 weeks.
**Hot offset begins at the temperatures shown. Minimum fuse at 280° F.
*Add 3 parts by volume Xerox Fuser Oil When compared with other polyalkyl functional siloxanes, for example, amino, carboxylic, epoxy and the like, the release is substantially improved, for example, the fusing latitude for carboxylic functional polydimethyl siloxane is about 280°–400° F., when used on a copper roll whereas the fusing latitude for a copper roll and the mercapto functional polydimethyl siloxanes having propyl spacer groups has reached to 450° F to 550° F. The thermal stability is generally at least 10** fold better for the mercapto functional polydimethyl siloxanes as it is for the equivalent siloxanes having functional groups other than mercapto.

EXAMPLE IX

The procedure of Examples I to VIII were followed except an aluminum roll was used as a fuser roll. A fusing latitude of 280°–360° F was obtained for a polydimethyl siloxane having six mercapto groups per molecule on propyl spacer groups, a molecular weight of 22,000 and a viscosity of about 1300 centistokes at 25° C.

EXAMPLE X

In a procedure similar to Example IX an end-blocked mercapto functional polydimethyl siloxane having 2.2 percent (by weight) sulfur attached to propyl spacer groups, had a fusing latitude of 280° to greater than 380° F, when used with an aluminum fuser roll.

EXAMPLE XI

Using a copper roll as described above for Examples IVIII and a modified thermoplastic resin toner having functional groups as described above and as described in Example II of U.S. Pat. No. 3,590,000, the following fusing latitudes set forth in Table 2 were obtained when mercapto functional polydimethyl siloxanes were used as fuser release agents.

TABLE 2

| SAMPLE NO. | MOL. Wt. | SPACER GROUP | VISCOSITY (centistokes) | S CONTENT | FUSING LATITUDE |
|---|---|---|---|---|---|
| 1 | 22,000 | Propyl | 1300 | 2 mol % | 220°–>340° F. |
| *2 | 1,000 | Propyl | 11 | 8 mol % | 220°–240° F. |
| 3 | 5,000 | Ethyl | 128 | 3 mol % | 220°–>350° F. |
| 4 | 15,000 | Propyl | 406 | 0.4 mol % | 220°–>360° F. |
| 5 | 8,000 | Propyl | -79 | 0.4 mol % | 220°–250° F. |
| **6 | 4,000 | Propyl | 83 | 0.4 mol % | 220°–330° F. |
| 7 | 14,000 | Propyl | 330 | 0.2 mol % | 220°–300° F. |

*Too Volatile
**Ethoxy groups (4.8% by weight) on the polydimethyl siloxane chain.

The results of Example XI show that reactive toners or modified toners having functional groups which react with the fuser member can be fused on bare metal fuser members coated with the polyalkyl siloxanes having mercapto functionality without offsetting.

EXAMPLE XII

The toner of Example I was fused on a bare copper roll and a bare stainless steel roll. Immediate release failure was observed in both cases at the minimum fuse temperature of 280° F as evidenced by offsetting on the roll.

EXAMPLE XIII

The toner of Example 1 was fused on both a copper and a stainless steel fuser roll coated with polydimethyl siloxane fluid (silicone oil). Immediate release failure was observed in both cases at the minimum fuse temperature of 280° F.

In all of the above examples where mercapto functional polydimethyl siloxanes were used as release agents on fuser rolls, it was observed that toner, whether the conventional non-reactive type or the modified reactive type, is displaced from scratches and gouges in the coating and that toner actually contacting the bare metal fuser member is displaced. by the mercapto-functional polydimethyl siloxanes and toner does not become entrapped in such interruptions in the film to cause deposits of toner on subsequent copies.

In accordance with the stated objects there has been demonstrated a release agent, a fusing process and a fusing member for fixing toner images. In all cases it was observed that the fuser member is self-repairing, the surface being continuously renewable. In the above experiments with the release agents, it was also observed that toner is actually displaced from exposed surfaces of fuser members having the polymeric fluids with mercapto functional groups thereon coated upon the surface, by reason of the action of the release agents. Experiments as set forth in the above examples were conducted and surface areas were gouged so that toner material became lodged upon the metal surfaces. In all cases the toner material was actively displaced from the surface of fuser members by the action of the release agent, and toner contamination of subsequent copies was avoided.

While the invention has been described with respect to preferred embodiments, it will be apparent that certain modifications and changes can be made without departing from the spirit and scope of the invention, and therefore, it is intended that the foregoing disclosure be limited only by the claims appended hereto.

What is claimed is:

1. A method of treating the surface of a heated, metal fuser member in an electrostatic reproducing apparatus comprising applying to said heated, metal fuser member surface an improved thermally stable polyalkyl siloxane capable of displacing modified electroscopic thermoplastic resin toner having functional groups which react with the metal of the fuser member, said polyalkyl siloxane containing mercapto-functional groups interacting with said metal fuser member surface to provide a thermally stable interfacial layer and being applied in an amount sufficient to cover said surface with at least a continuous, low surface energy fluid film of said polyalkyl siloxane to provide said metal fuser member with a heated surface which releases thermoplastic resin toner deposited on a substrate and heated by the metal fuser member and prevents said thermoplastic resin toner from contacting the surface of the metal fuser member, the polyalkyl siloxane containing mercapto-functional groups remaining fluid on the surface at operating temperatures between about 220° F and 400°.

2. The method of claim 1 comprising continuously applying the polyalkyl siloxane containing mercapto-functional groups on the metal fuser member to maintain thereon a coating of the fluid and its reaction products with the metal fuser member.

3. The method of claim 2 wherein the thickness of the polyalkyl siloxane fluid containing mercapto-functional groups deposited on the metal fuser member is maintained at about 0.5 to about 10 microns.

4. The method of claim 1 wherein the mercapto-functional polyalkyl siloxane fluid is not curable to the extent that it forms a solid or gel at operating temperatures between about 220° F and 400° F for a reasonable period of time of at least about 200 hours.

5. The method of claim 1 wherein the surface energy of the polymer fluid is less than that of the toner at operating temperatures between about 220° F and 400° F.

6. The method of fusing modified electroscopic thermoplastic resin toner images to a substrate, said toner having functional groups which react with the metal of a fuser member, including the steps of:

(a) forming a film on a heated, metal fuser member in an electrostatic reproducing apparatus, said film being a barrier to said modified electroscopic thermoplastic resin toner having functional groups and comprising the product resulting from the interaction of the metal fuser member and a polyalkyl siloxane having reactive mercapto-functional groups thereon which interact with the metal fuser member, said mercapto-functional polyalkyl siloxane being fluid at the temperature between about 220° F and 400° F of the metal fuser member and acting as an improved release fluid film for the electroscopic thermoplastic resin toner having functional groups, said film having improved thermal stability;

b. contacting the toner images on said substrate with the coated, heated, metal fuser member for a period of time sufficient to soften the electroscopic thermoplastic resin toner having functional groups; and (c) allowing the toner to cool.

7. The method of claim 6 comprising continuously depositing the mercapto-functional polyalkyl siloxane on the heated, metal fuser member to maintain a toner barrier coating and fluid, toner release film of at least about 0.5 micron in thickness.

8. The method of claim 7 wherein the thickness of the film is maintained at about 1 to about 4 microns.

9. The method of claim 6 wherein the mercapto functional groups are substituted on alkyl spacer groups on the polyalkyl siloxane.

10. The method of claim 9 wherein the alkyl spacer groups have from about 1–8 carbon atoms.

11. The method of claim 9 wherein the alkyl spacer groups are propyl groups.

12. The method of claim 6 wherein the concentration of mercapto functional groups is from about 0.2 functional groups per molecule to about 2 functional groups per molecule.

13. The method of claim 9 wherein the polyalkyl siloxane having reactive mercapto functional groups thereon comprises a polysiloxane backbone of the dialkyl type having the formula:

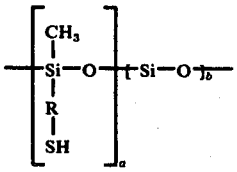

wherein R is a propyl group and a is. from about 0.2 to about 2.0 per molecule.

14. The method of claim 6 comprising contacting the heated fuser member with said mercaptofunctional polyalkyl siloxane which is a solid or liquid at ambient temperature and a liquid at operating temperatures.

* * * * *